United States Patent [19]

Pennock

[11] Patent Number: 5,029,903

[45] Date of Patent: Jul. 9, 1991

[54] WALLET SIZE NOTE PACK

[75] Inventor: Thomas G. Pennock, North Tonawanda, N.Y.

[73] Assignee: Moore Business Forms, Inc., Grand Island, N.Y.

[21] Appl. No.: 569,447

[22] Filed: Aug. 20, 1990

[51] Int. Cl.[5] ..... B42D 15/00

[52] U.S. Cl. ..... 283/81; 281/2; 281/5; 283/62

[58] Field of Search ..... 283/81, 101, 62, 61; 281/15.1, 5, 2, ; 282/DIG. 2; 40/155, 594, 638, 124.1

[56] References Cited

U.S. PATENT DOCUMENTS

| | | | |
|---|---|---|---|
| 683,632 | 10/1901 | Wright | 281/15.1 |
| 2,436,888 | 3/1948 | Hess et al. | 282/DIG. 2 |
| 3,290,059 | 12/1966 | Newman | 283/81 |
| 3,299,556 | 1/1967 | Stiefel | 40/124 |
| 3,460,281 | 8/1969 | Levy | 40/63 |
| 3,949,935 | 4/1976 | Stackig | 40/125 |
| 4,627,994 | 12/1986 | Welsch | 283/81 |
| 4,669,754 | 6/1987 | Lalonde | 283/67 |
| 4,757,901 | 7/1988 | Woods | 40/638 |
| 4,778,153 | 10/1988 | Bachman et al. | 283/101 |
| 4,832,372 | 5/1989 | Young | 281/31 |
| 4,907,904 | 8/1990 | Baldwin | 402/80 R |
| 4,952,433 | 8/1990 | Tezuka et al. | 281/5 |

OTHER PUBLICATIONS

"Color Coding Labels", by Avery, Jacobs Garden Office Products, 1988.

"Post-it Note", by 3M, 1987.

Wallet size note pack from U.S. Patent Office, 1988.

*Primary Examiner*—Frank T. Yost

*Assistant Examiner*—Hwei-Siu Payer

*Attorney, Agent, or Firm*—Nixon & Vanderhye

[57] ABSTRACT

A wallet size note pack is provided which includes a paper web, at least one side of which is provided with a release coating and a plurality of low tack adhesive note sheets. In an exemplary embodiment, the paper web includes two fold lines dividing the web into three substantially equally sized panels, each of which is provided with a plurality of the low tack adhesive note sheets arranged in orderly arrays.

13 Claims, 2 Drawing Sheets

WALLET SIZE NOTE PACK

BACKGROUND AND SUMMARY OF THE INVENTION

The widespread use of repositionable adhesive note sheets, typically provided in pad form, has been well documented. Such pads typically comprise a plurality of relatively small note sheets, the back of which is provided with one or more strips of a low tack adhesive material, enabling individual note sheets to be removed from the pad and adhesively secured to another surface. An example of such note pad construction is the NOTE STIX® brand manufactured and sold by the assignee of this invention.

A disadvantage to the conventional note pad construction is that it is too bulky to be carried within a wallet, pocket or the like. In order to more fully utilize the potential usefulness of low tack adhesive note sheets, the present invention provides a wallet size note pack which contains a number of low tack adhesive note sheets within a thin, multi-folded paper web with dimensions similar to those of, for example, a credit card.

Thus, in one embodiment of the invention, a multi-fold paper web is provided at least one side of which is provided with a release coating and a plurality of low tack adhesive note sheets. In an exemplary embodiment, the paper web includes two fold lines dividing the web into three substantially equally sized panels, each of which is provided with a plurality of the low tack adhesive note sheets arranged in orderly arrays.

It is a further feature of the invention that certain of the note sheets have sizes shapes and colors different than that of other of the note sheets. In addition, some of the note sheets may include perforation lines enabling such sheets to be divided for purposes of record keeping or the like.

Printed matter may appear on the coated side of the paper in the form of motivational and/or witty sayings, important dates or the like. These may appear adjacent or beneath the note sheets as desired.

It is a further feature of the invention that the other side of the multi-fold paper web may include advertising related indicia printed thereon, as well as reference information such as a calendar.

It will be appreciated by those of ordinary skill in the art that the wallet size note pack of this invention can be configured in many sizes and shapes with fewer or greater numbers of panels and low tack adhesive note sheets, arranged in any number of ways.

Other objects and advantages will become apparent from the detailed description of the invention which follows.

DETAILED DESCRIPTION OF THE DRAWINGS

Figure 1:
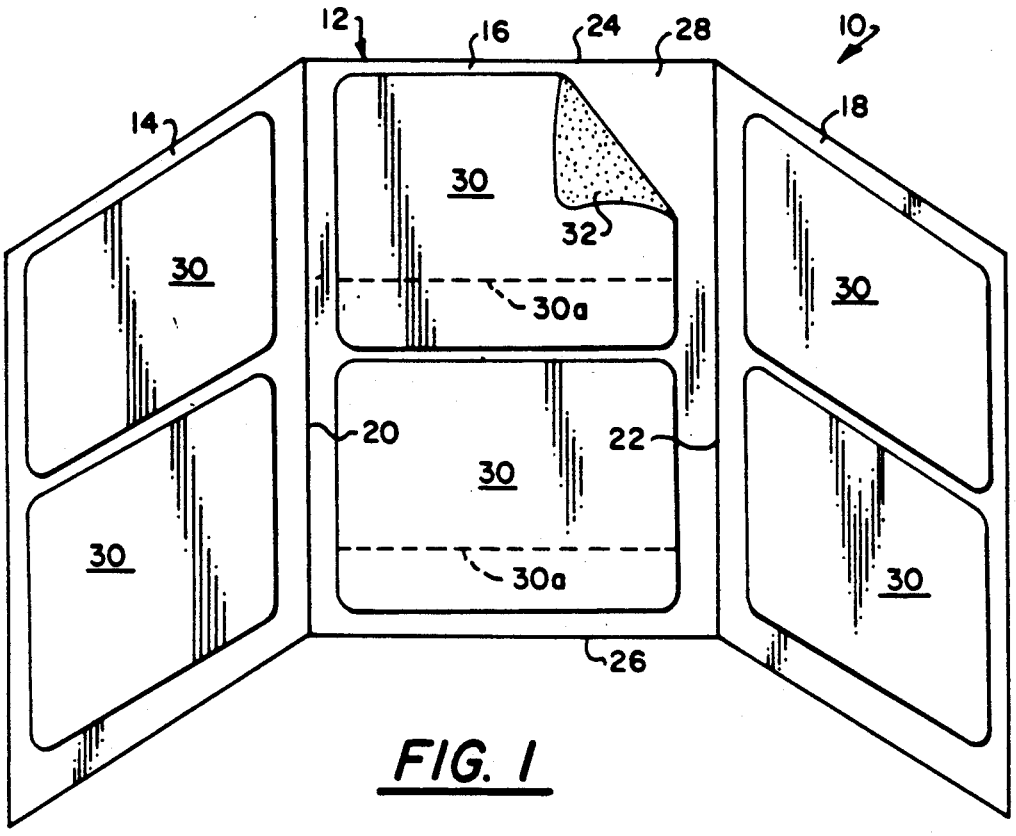
FIG. 1 is a perspective view of a wallet size note pack in accordance with a first exemplary embodiment of the invention.
Figure 2:
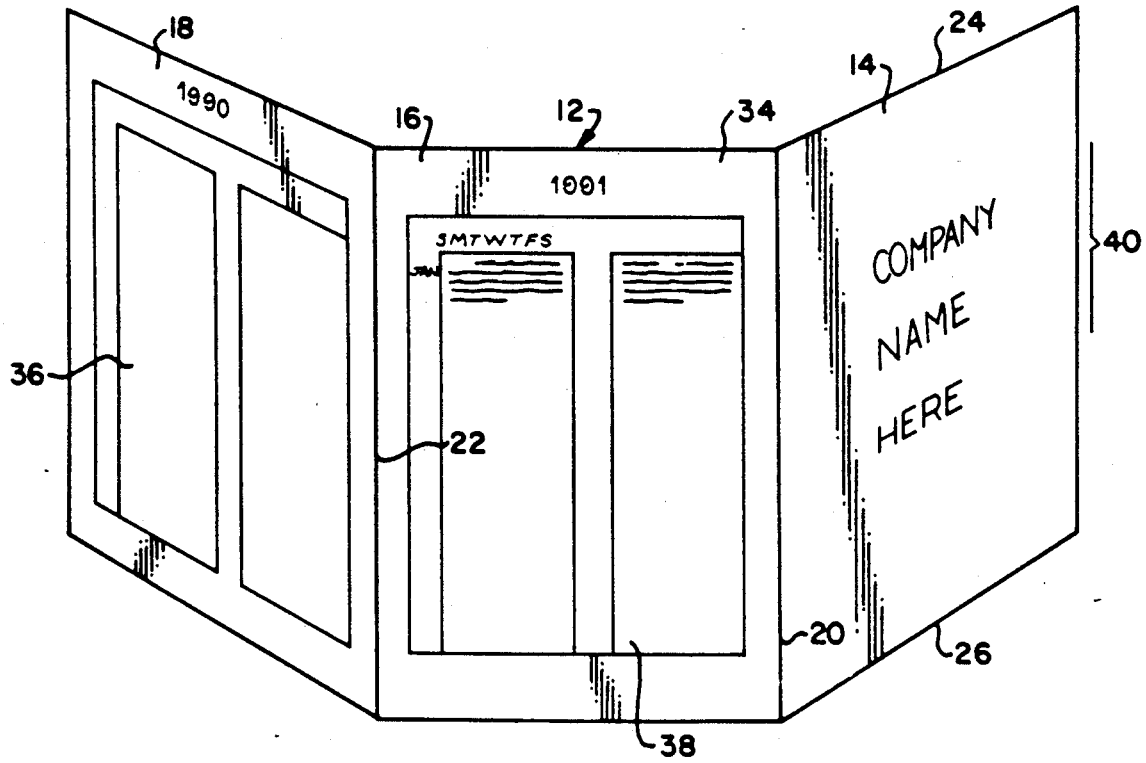
FIG. 2 is a perspective view of the reverse side of the wallet size note pack illustrated in FIG. 1.
Figure 5:
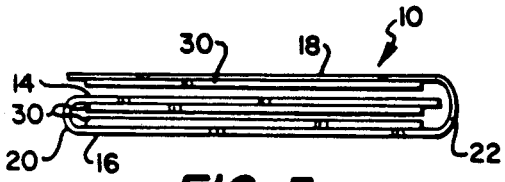
FIG. 5 is an end view of the embodiment illustrated in FIG. 1 in folded form.

Referring now to FIGS. 1 and 2, a wallet size note pack 10 in accordance with a first exemplary embodiment of the invention is constructed from a paper web 12 which is divided into a plurality of panels 14, 16 and 18 by a pair of substantially parallel fold lines 20 and 22 extending between the upper and lower edges 24, 26, respectively, of the paper web. The fold lines 20 and 22 are laterally spaced such that each of the panels 14, 16 and 18 has approximately equal length and width dimensions. This permits the web to be folded into a three layer arrangement as shown in FIG. 5, thereby facilitating easy carrying of the pack within, for example, a wallet, pocket, purse, etc.

The paper web 12 is provided on at least one surface 28 (also referred to herein as the interior surface) with a conventional release coating which permits a plurality of low tack adhesive note sheets 30 to be removably secured thereto. The note sheets 30 are provided on their back surfaces with a low tack adhesive 32 of the type manufactured by the assignee of this application under the name NOTE STIX®. As shown in FIG. 1, the note sheets 30 are substantially identical in dimensions and are mounted in an orderly array on the interior surface of each of the panels 14, 16 and 18.

The outer or exterior surface 34 of the paper web 12 may be provided with general reference information such as the calendar charts 36, 38, and may also include the name of a customer or client company as indicated at 40.

Other information in the form of motivational sayings, proverbs, jokes, famous quotes, important dates or the like may be included as desired on one and/or the other of surfaces 28, 34. These may appear adjacent or beneath one or more of the note sheets 30, or anywhere on either side of the web as desired.

It will also be appreciated that the exterior surface 34 may also have all or a portion thereof coated with a suitable release composition to permit the carrying of additional note sheets 30.

It is also within the scope of this invention that one or more of the note sheets 30 be divided by a perforation line as shown at 30*a*, thereby enabling one portion of the note sheet to be removed from the remaining portion. This arrangement provides an added degree of versatility and flexibility with respect to potential uses for the sheets, e.g., record keeping, tagging schemes, etc.

It will be appreciated that the above construction provides a handy source of removable and repositionable note sheets 30 which may be separated from the wallet pack 10 and applied where desired. It will be appreciated, of course, that in the event a previously applied note sheet 30 is removed from a particular article, it may be reattached to the wallet pack for later use. At the same time, the wallet pack can serve as a promotional item, with a company name 40 (and related phone numbers, addresses, etc.) indicating a source of goods and/or services or the like.

Figure 3:
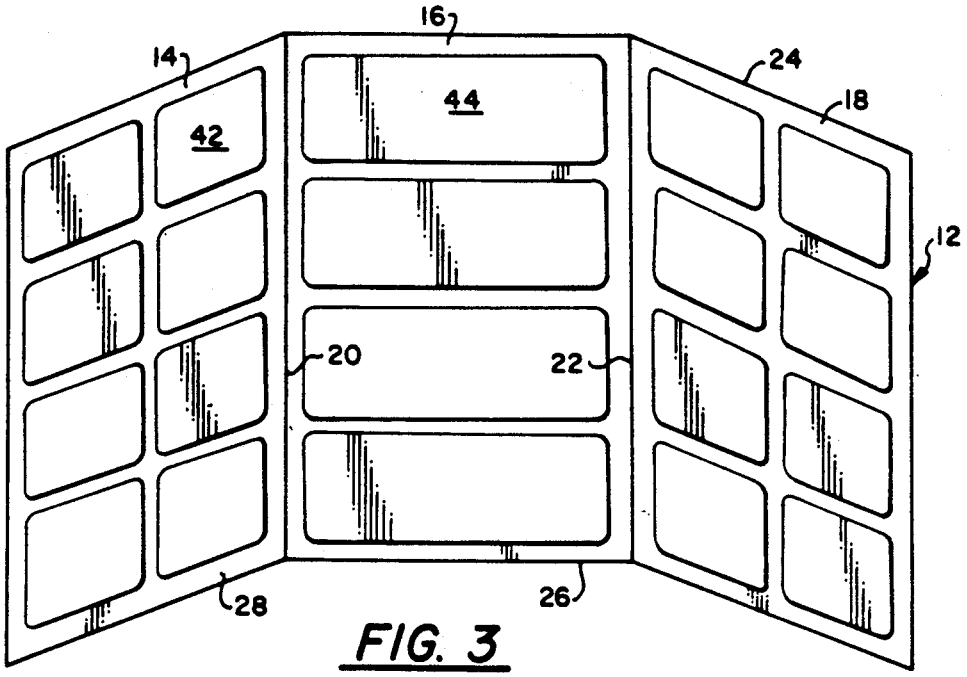
FIG. 3 is a perspective view of another exemplary embodiment of a wallet size note pack in accordance with this invention.

Turning now to FIG. 3, a second exemplary embodiment of the invention is illustrated wherein the construction of the wallet pack 10 including the paper web 12 is substantially identical to the embodiment illustrated in FIGS. 1 and 2. However, in FIG. 3, an added degree of versatility is provided in that different size and shaped note sheets 42, 44 are adhered to the interior surface 28 of the paper web 12. Specifically, an orderly array of smaller note sheets 42 is provided on each of the panels 14 and 18 while a lesser number of larger note sheets 44 is provided on the interior surface of the panel 16. This arrangement permits the user to select an appropriate size and shape note sheet for a particular use.

Figure 4:
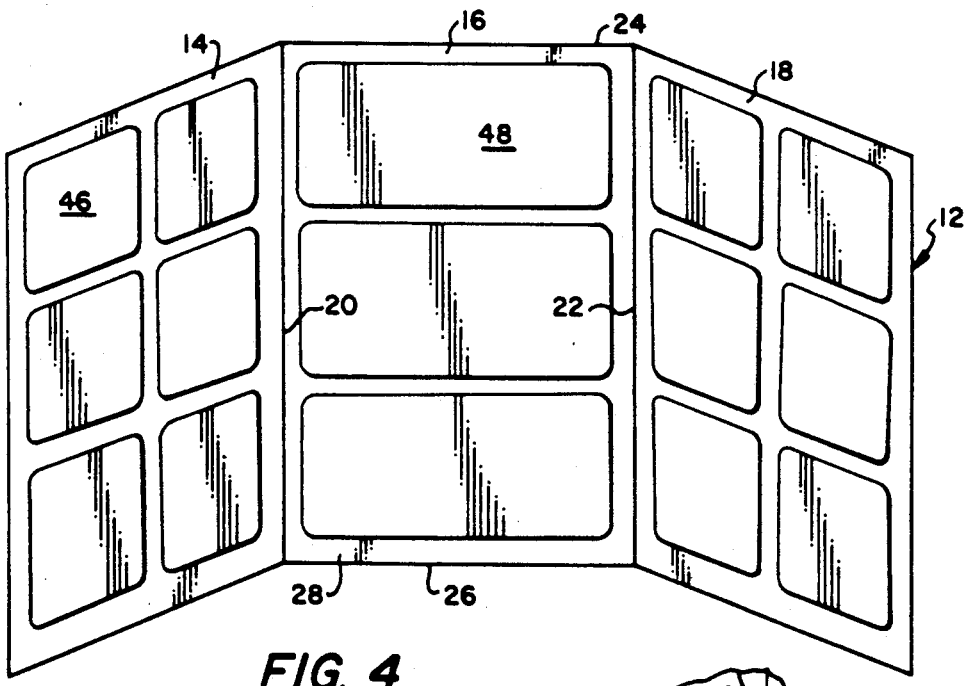
FIG. 4 is a perspective view of still another exemplary embodiment of the subject invention.

In FIG. 4, a third exemplary embodiment of the invention is illustrated wherein panels 14 and 18 have applied thereto an array of six note sheets 46 and the panel 16 has three relatively large note sheets 48 applied thereto.

FIG. 5 illustrates an end view of the wallet-size note pack 10 of the FIG. 1 embodiment folded about fold lines 20 and 22 to a three layer arrangement which permits easy insertion and removal from, for example, a wallet, purse, etc. The thicknesses of the note sheets 30 in the FIG. 5 illustration have been exaggerated merely for purposes of clarity. The overall dimensions of the wallet pack in the folded position are similar to those of a credit card or the like.

Figure 6:
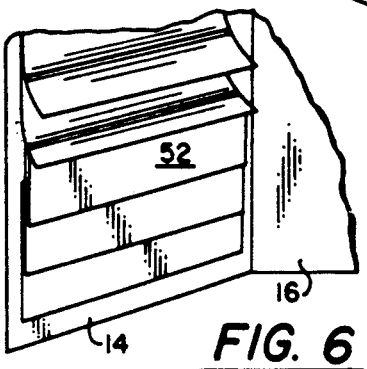
FIG. 6 is a partial perspective view of still another exemplary embodiment of the subject invention.

FIG. 6 shows still another arrangement wherein rectangular note sheets 52 are arranged on the interior surface 28 of panel 14 in a shingled fashion.

It will be appreciated that virtually any combination of sizes and shapes of note sheets can be applied to the panels of the wallet size note pack and remain within the scope of this invention.

As will be understood by those of ordinary skill in the art the size of the individual panels 14, 16 and 18 may also be altered as desired, and the number of panels as defined by the number of fold lines may be altered as well. Thus, for example, a note pack may be provided which, for example, includes only a single panel 12 printed with reference data on one side and carrying one (but preferably two or more) adhesive note sheets. Two panel sheets with a single fold line may also be provided. At the other end of the spectrum, a large number "n" of panels may be formed by providing "n−1" fold lines so as to produce an accordion-like pack which would, of course, significantly increase the note sheet capacity of the pack.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A wallet-sized note pack comprising a paper web, at least one side of which is provided with a release coating, and a plurality of low tack adhesive note sheets individually and removably secured to said one side, the other side of said paper web having reference indicia printed thereon including at least one calendar chart.

2. The note pack according to claim 1 wherein said paper web includes at least one fold line dividing said web into at least two panels, each of which is provided with a plurality of said low tack adhesive note sheets.

3. The note pack according to claim 2 wherein at least some of said note sheets have sizes and shapes different than others of said note sheets.

4. The note pack according to claim 1 wherein the other side of said paper web includes advertising related indicia printed thereon.

5. The note pack according to claim 1 wherein at least some of said plurality of low tack adhesive note sheets are secured in a shingled arrangement.

6. A carrier assembly for a plurality of low tack adhesive note sheets comprising a paper web defined by upper, lower and side edges, and having a first side coated with a release coating and a second side printed with indicia relating to a source of goods or services; said web being divided into at least two substantially identical panels by at least one fold line extending between at least two of said upper, lower and side edges; said first side of said web having removably and individually secured thereon an orderly array of low tack adhesive note sheets, wherein at least a portion of said orderly array of low tack adhesive note sheets are secured in a shingled arrangement.

7. A carrier assembly according to claim 6 wherein said second side of said web includes general reference information.

8. A carrier assembly according to claim 6 wherein said web is divided into three substantially identical panels by two parallel fold lines.

9. A carrier assembly according to claim 6 wherein said web is divided into at least n substantially identical panels by at least n−1 fold lines, wherein n is greater than 2.

10. A carrier assembly according to claim 6 wherein said second side is also provided with at least one calendar chart.

11. A carrier assembly according to claim 6 wherein each of said panels measures approximately 2 inches by three inches, such that said web may be folded about said at least one fold line to a size no larger than that of each of said panels.

12. A carrier assembly according to claim 11 wherein said note sheets are provided in at least two sizes and shapes.

13. A carrier assembly according to claim 12 wherein said note sheets are color-coded by size and shape.

* * * * *